United States Patent [19]

Tanaka

[11] 4,451,159

[45] May 29, 1984

[54] ELECTRONIC WATCH

[75] Inventor: Mitsunori Tanaka, Tokyo, Japan

[73] Assignee: Seiko Instruments & Electronics Ltd., Tokyo, Japan

[21] Appl. No.: 349,382

[22] Filed: Feb. 16, 1982

[30] Foreign Application Priority Data

Mar. 6, 1981 [JP] Japan ..... 56-32071

[51] Int. Cl.[3] ..... G04C 17/00

[52] U.S. Cl. ..... 368/69; 368/187; 368/200

[58] Field of Search ..... 364/705; 368/10, 69, 368/70, 184–189, 200–202

[56] References Cited

U.S. PATENT DOCUMENTS

| | | | |
|---|---|---|---|
| 4,019,037 | 4/1977 | Monna | 364/705 |
| 4,086,654 | 4/1978 | Ido et al. | 368/10 X |
| 4,300,204 | 11/1982 | Maeda et al. | 368/10 X |

*Primary Examiner*—Ulysses Weldon

*Attorney, Agent, or Firm*—Robert E. Burns; Emmanuel J. Lobato; Bruce L. Adams

[57] ABSTRACT

A multi-mode electronic timepiece includes a case body on which an annular dial is mounted for angular stepwise displacement. A circuit board is mounted within the case body and includes a plurality of angularly spaced-apart switch terminal patterns connected to circuitry for generating different mode signals depending on which of the switch terminal patterns are actuated. A plurality of switches are disposed adjacent respective ones of the switch terminal patterns and each switch includes a movable rod movable between first and second positions to actuate or not actuate its respective switch terminal pattern. The underside of the annular dial is provided with a plurality of angularly spaced-apart camming portions which are suitably located to cam the switch rods in response to manual angular stepwise displacement of the dial to actuate selected ones of the switches to accordingly actuate selected ones of the switch terminal patterns and produce a corresponding mode signal. The number of camming portions on the dial is greater than the number of switches and switch terminal patterns so that depending on the angular position of the dial, different combinations of switch terminal patterns will be actuated to produce a mode signal corresponding to the selected position of the dial.

18 Claims, 17 Drawing Figures

ELECTRONIC WATCH

BACKGROUND OF THE INVENTION

The present invention relates to an electronic watch, and more particularly to a rotary switch of an electronic watch making use of a dial on a casing.

In a conventional switching device of an electronic watch, switching operations are carried out by pushing buttons provided on a side surface or front surface of a casing. This method is disadvantageous in that it is difficult to discriminate between the functions of each button on the side surface of the casing and that it is hard to make out how often the button has to be pressed on to recall a desired mode. Consequently a user has an impression that the operation of the watch is hard to understand.

In case buttons are provided on the front surface of the watch, one mode is recalled by pushing one button: this is what is called a direct recall and is quite easy to operate in case a small number of modes are incorporated. As the number of the buttons increase in accordance with an increase in the number of functions, however, it becomes impossible to provide a number of buttons corresponding to the number of modes because of limitation of space.

SUMMARY OF THE INVENTION

The present invention aims to eliminate the above noted drawbacks, and therefore, it is an object of the present invention to carry out more switching operations than the number of switch terminal patterns by providing concave or convex portions on a dial mounted on a casing, and plural switch terminal patterns on a circuit board at given intervals. Namely, the present invention aims to carry out a number of switching operations making use of a small number of the switch terminal patterns.

Hereinafter the present invention will be illustrated in conjunction with the drawings.

DETAILED DESCRIPTION OF THE INVENTION

Figure 1:
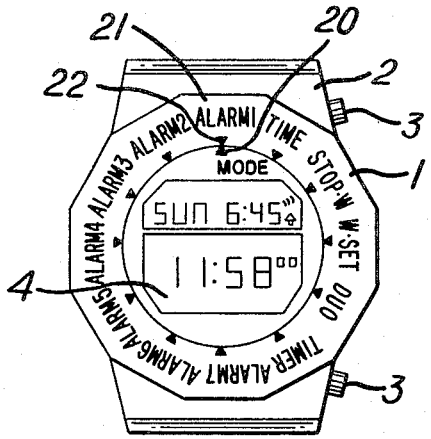
FIG. 1, FIG. 6, FIG. 10 and FIG. 14 show plan views of the embodiments in accordance with the invention.

FIG. 1 shows a plan view of a first embodiment of the present invention. Reference numeral 1 denotes an annular dial, 2 denotes a casing body, 3 denotes buttons provided on a side surface of the casing, 4 denotes a display portion of a watch and 20 denotes a mode indication mark. Indicia 21 indicates the names of each mode and mode positioning marks 22 are displayed on the dial 1. The figure shows that the present mode is "ALARM I".

Figure 2:
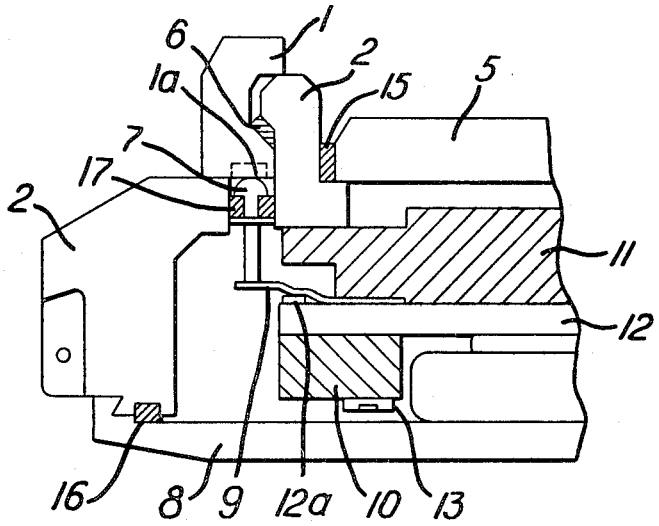
FIG. 2 shows a sectional view of the embodiment in accordance with the invention.

FIG. 2 shows a partial sectional view of the first embodiment of the present invention. The dial 1 is mounted on the casing pushed against the casing body 2 by a gasket 6. The gasket 6 is provided to produce a torque when the dial is being angularly displaced or rotated. A module is incorporated in the water-proof casing sealed by gaskets 15, 16 and 17 provided adjacent to a glass 5, a back cover 8 and a mode change-over switch button 7. The mode change-over switch button 7 is pushed by convex camming portions 1*a* on the underside of the dial 1 between a first position (shown in FIG. 2) to push a mode change-over switch plate 9 against a circuit board 12 and to a second position (not shown) in which the plate 9 is not pushed against the circuit board 12. The mode change-over switch plate 9 is in contact with switch terminal patterns 12*a* deposited on the circuit board 12 to turn on the mode change-over switch. The mode change-over switch plate 9 is fixed by tightening a screw 13 sandwiched between a battery frame 10, the circuit board 12 and a panel frame 11. The mode change-over switch plate is provided over a pattern VDD on the circuit board 12 to be in contact with it by tightening the screw 13. In case the camming portions 1*a* of the dial are of concave shape, the mode change-over switch button 7 is pushed upwardly by repulsion of the mode change-over switch plate 9, and a contact between the mode change-over switch plate 9 and the switch terminal pattern 12 is released.

The switch button 7 and the mode change-over switch plate 9 comprise a switch which is actuated by the camming portions or switch actuators 1*a* on the underside of the dial 1 for actuating one of the switch terminal patterns 12. As explained below, the electronic timepiece includes a plurality of such switches disposed in a circular pattern.

Figure 3:
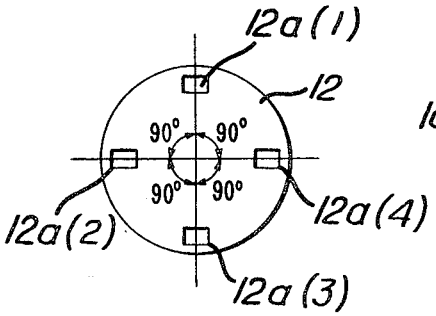
FIG. 3, FIG. 7, FIG. 11 and FIG. 15 show circuit pattern diagrams of the embodiments in accordance with the invention.

FIG. 3 shows an arrangement of the switch terminal patterns 12*a* on the circuit board 12, in which four switch terminal patterns are deposited in a circular pattern at angularly spaced intervals of 90° respectively.

Figure 4:
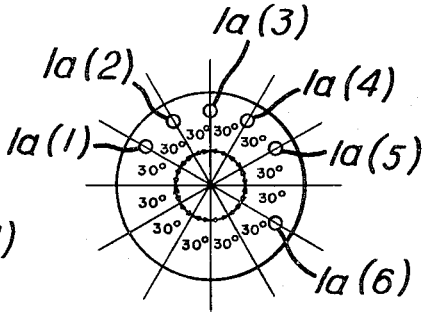
FIG. 4, FIG. 8, FIG. 12 and FIG. 16 show plan views of a dial in accordance with the invention.

FIG. 4 shows an arrangement of convex actuating portions 1*a* on the dial 1. The convex portions 1*a* are on the same circumference as the switch terminals 12*a*, in which the convex portions 1*a*(1) to 1*a*(5) are positioned at angularly spaced intervals of 30° respectively and the convex portion 1*a*(6) is positioned at an angular interval of 60° from 1*a*(5).

Figure 5:
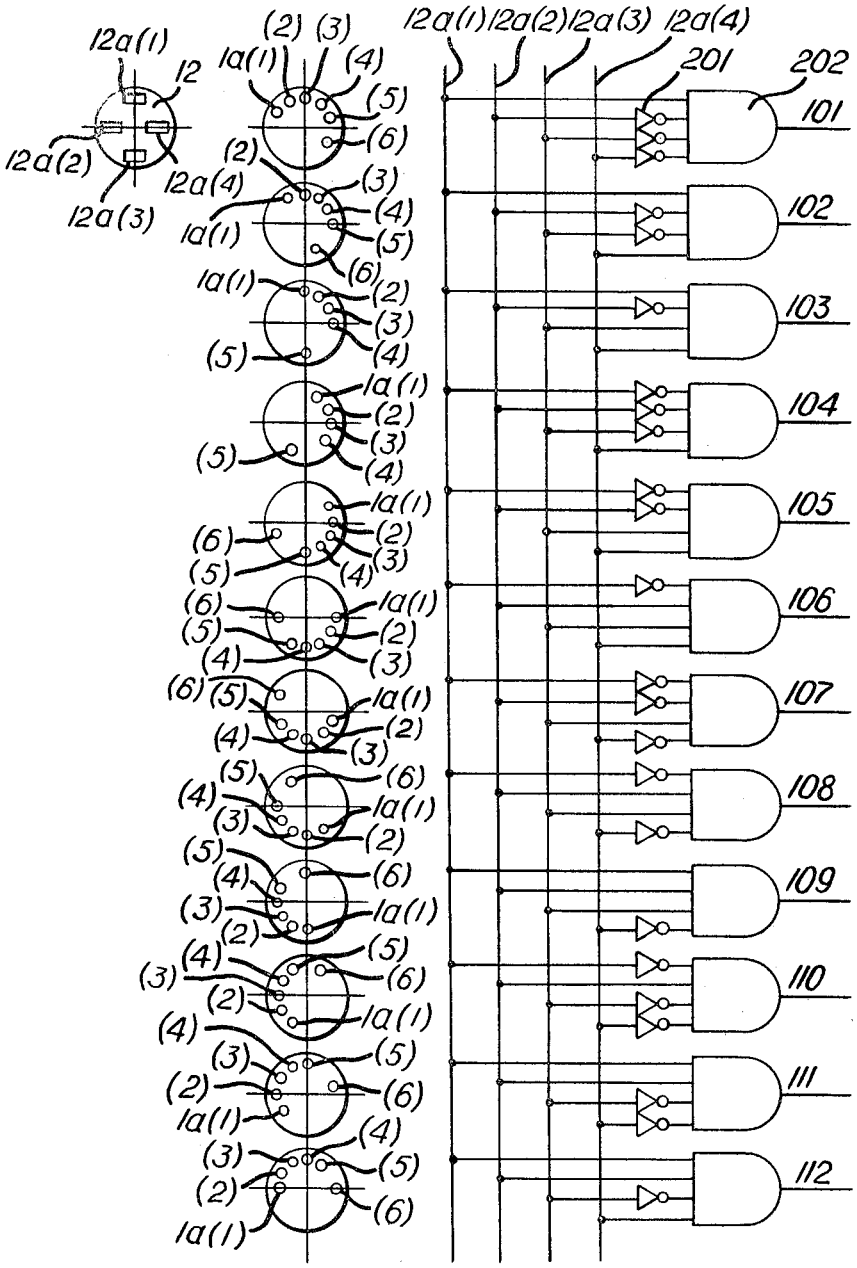
FIG. 5, FIG. 9, FIG. 13 and FIG. 17 show logic diagrams combining switch inputs of the embodiments in accordance with the invention.

FIG. 5 shows a logic diagram of the switch inputs of the first embodiment according to the present invention. When the dial is rotated, twelve switching operations are carried out by combining the switch terminals 12*a*(1), 12*a*(2), 12*a*(3) and 12*a*(4) on the circuit board with the convex camming portions 1*a*(1), 1*a*(2), 1*a*(3), 1*a*(4), 1*a*(5) and 1*a*(6) on the dial 1. As shown, the switch terminal pattern 12*a*(1) corresponds to the portion of the convex portion 1*a*(3) on the dial 1, and thus a switching operation is carried out and an AND circuit 202 produces a signal 101. Since the other switch terminal patterns 12*a*(2), 12*a*(3) and 12*a*(4) do not correspond to positions of the convex camming portions 1*a* on the dial 1, the switching operations are not carried out, and the outputs are inverted from an OFF state to an ON state by an inverter 201 before they are fed to the AND circuit 202. As a result, the AND circuit 202 is turned on and produces signal 101. After this twelve switching operations are carried out by rotating the dial 1 at 30° increments twelve times.

Figure 6:
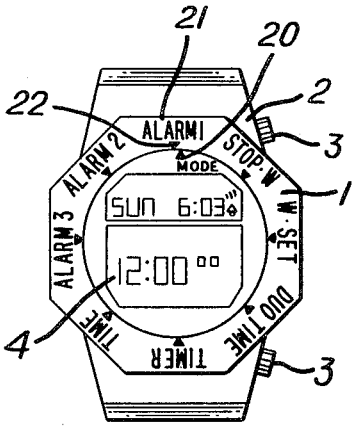

FIG. 6 shows a plan view of a second embodiment of the present invention. Reference numeral 1 denotes a dial, 2 denotes a casing body, 3 denotes buttons provided on side surfaces of the casing, 4 denotes a display portion of a watch and 20 denotes a mode indication mark. Eight names 21 of each mode and mode positioning marks are displayed on the dial 1. The figure shows that the present mode is ALARM I.

Figure 7:
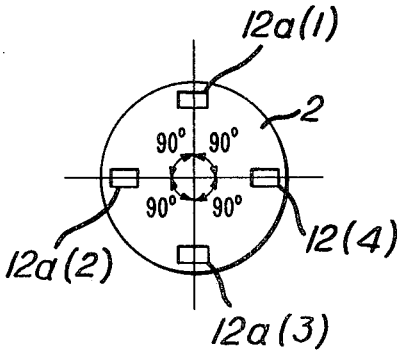

FIG. 7 shows an arrangement of switch terminal patterns 12*a* on a circuit board 12, in which four switch terminal patterns are deposited at angularly spaced intervals of 90° respectively.

Figure 8:
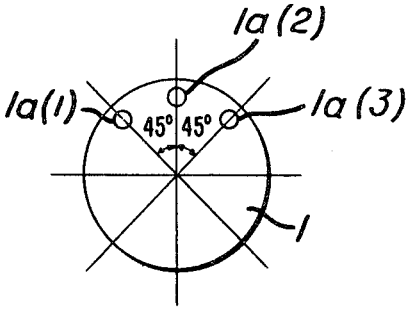

FIG. 8 shows an arrangement of convex camming portions 1*a* on the dial 1. The convex camming portions 1*a* (1), 1*a*(2) and 1*a*(3) are on the same circumference as the switch terminal patterns 12*a* and positioned at angularly spaced intervals of 45° respectively.

Figure 9:
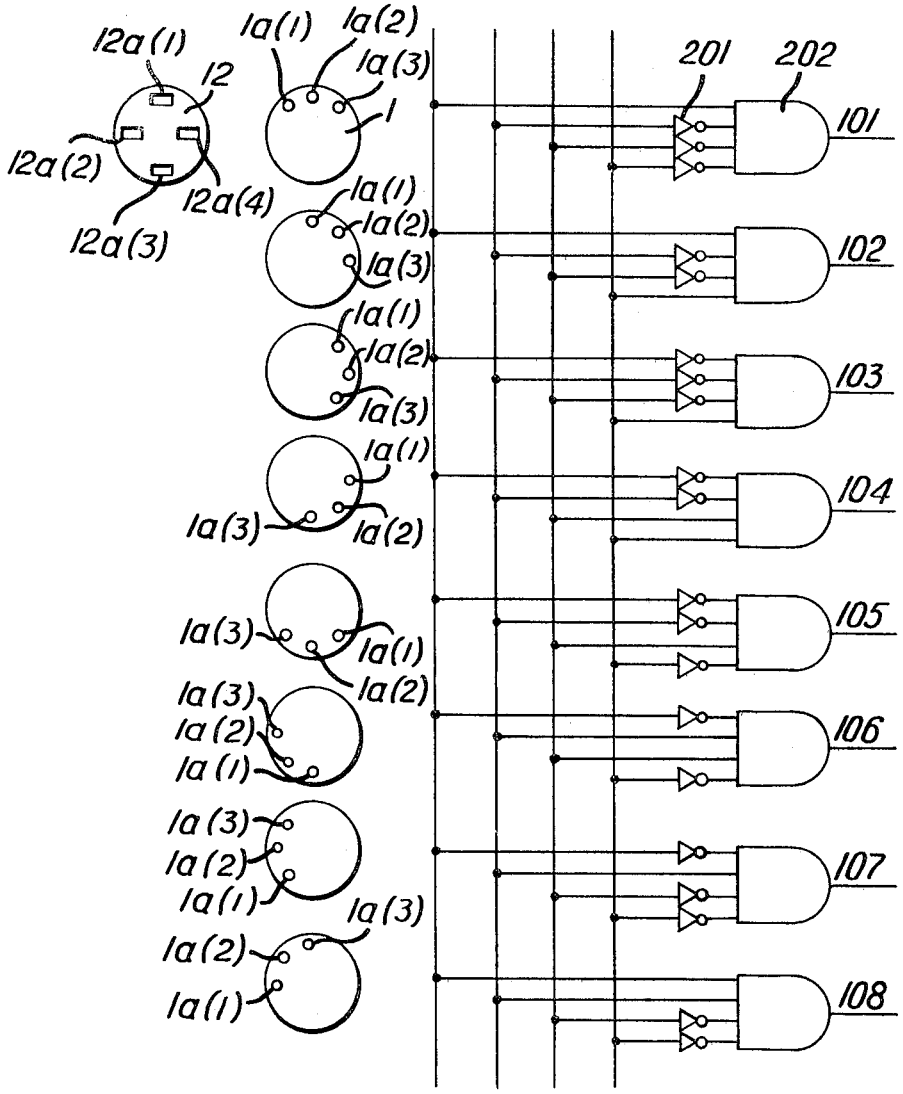

FIG. 9 shows a logic diagram combining the switch inputs of the second embodiment according to the present invention. When the dial is rotated, eight switching operations are carried out by combining the switch terminal patterns 12*a*(1), 12*a*(2), 12*a*(3) and 12*a*(4) on the circuit board 12 with the convex portions 1*a*(1), 1*a*(2) and 1*a*(3) of the dial 1. Since the switch terminal pattern 12*a*(1) corresponds to the position of the convex portion 1*a*(2) on the dial 1, the switching operation is carried out and an AND circuit 202 produces a signal 101. Since the other switch terminal patterns 12*a*(2), 12*a*(3) and 12*a*(4) do not correspond to positions of the convex portions 1*a* on the dial 1, the switching operations are not carried out, and the outputs are inverted from an OFF state to an ON state by an inverter 201 before they are fed to the AND circuit 202. As a result the AND circuit 202 is turned on and produces signal 101. After this eight switching operations are carried out by rotating the dial 1 by 45° increments eight times.

Figure 10:
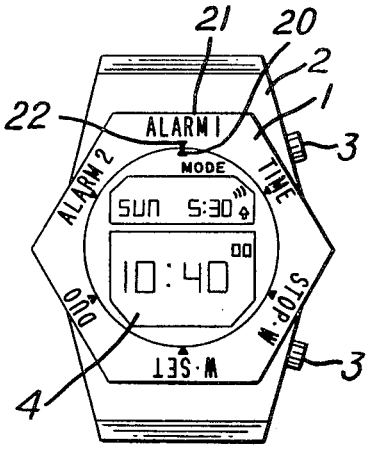

FIG. 10 shows a plan view of a third embodiment of the present invention. Reference numeral 1 denotes a dial, 2 denotes a casing body, 3 denotes buttons provided on side surfaces of the casing, 4 denotes a display portion of a watch and 20 denotes a mode indication mark. Six names 21 of each mode and mode positioning marks 22 are displayed on the dial 1. The figure shows that the present mode is ALARM I.

Figure 11:
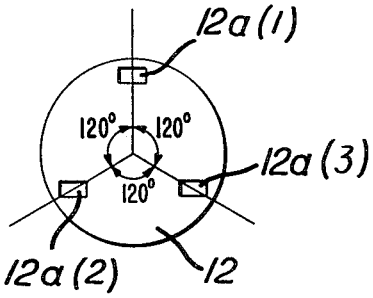

FIG. 11 shows an arrangement of switch terminal patterns 12*a* on a circuit board 12, in which three switch terminal patterns are deposited at angularly spaced intervals of 120° respectively.

Figure 12:
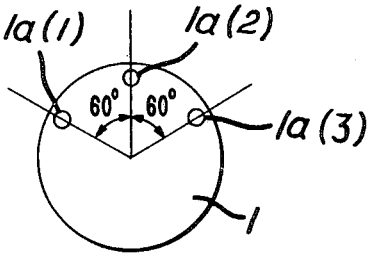

FIG. 12 shows an arrangement of convex portion 1*a* on the dial 1, The convex portions 1*a*(1), 1*a*(2) and 1*a*(3) are on the same circumference as the switch terminal patterns 12*a* and positioned at angular intervals of 60° respectively.

Figure 13:
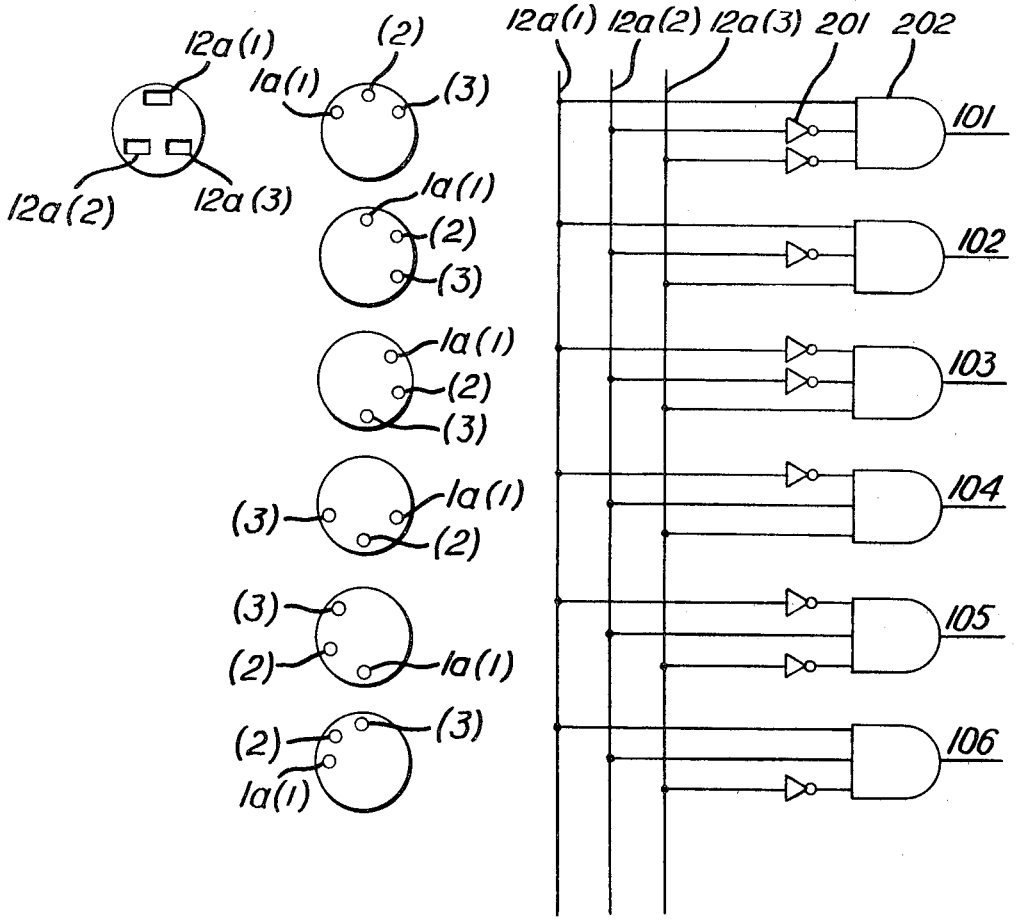

FIG. 13 shows a logic diagram combining the switch inputs of the third embodiment according to the present invention. When the dial 1 is rotated, six switching operations are carried out by combining the switch terminal patterns 12*a*(1), 12*a*(2) and 12*a*(3) on the circuit board 12 with the convex portions 1*a*(1), 1*a*(2) and 1*a*(3) on the dial 1. Since the switch terminal pattern 12*a*(1) corresponds to the position of convex portion 1*a*(2) on the dial 1, the switching operation is carried out and an AND circuit 202 produces a signal 101. Since the other switch terminal patterns 12*a*(2) and 12*a*(3) do not correspond to positions of the convex portions 1*a* on the dial 1, the switching operations are not carried out, and the outputs are inverted from an OFF state to an ON state by an inverter 201 before they are fed to the AND circuit 202. As a result the AND circuit 202 is turned on and produces the signal 101. After this six switching operations are carried out by rotating the dial 1 by 60° increments six times.

Figure 14:
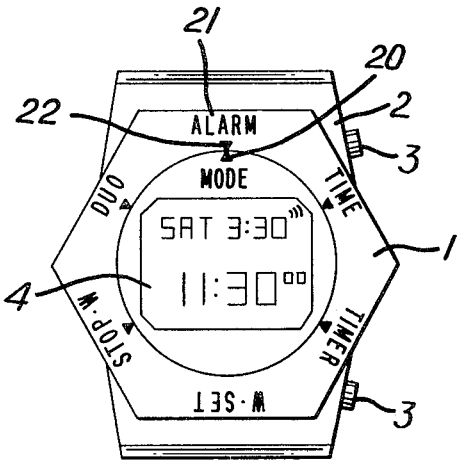

FIG. 14 shows a plan view of a fourth embodiment of the present invention. Reference numeral 1 denotes a dial, 2 denotes a casing body, 3 denotes buttons provided on side surfaces of the casing, 4 denotes a display portion of a watch and 20 denotes a mode indication mark. Since names 21 of each mode and mode positioning marks 22 are displayed on the dial 1. The figure shows that the present mode is ALARM I.

Figure 15:
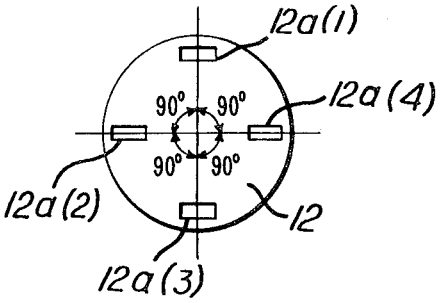

FIG. 15 shows an arrangement of switch terminal patterns 12*a* on a circuit board 12, in which four switch terminal patterns are deposited at angular intervals of 90° respectively.

Figure 16:
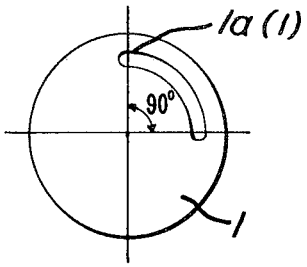

FIG. 16 shows an arrangement of a convex camming portion 1*a* on the dial 1. The convex portion 1*a*(1) is on the same circumference as the switch terminal patterns 12*a* and in the shape of a quarter arc.

Figure 17:
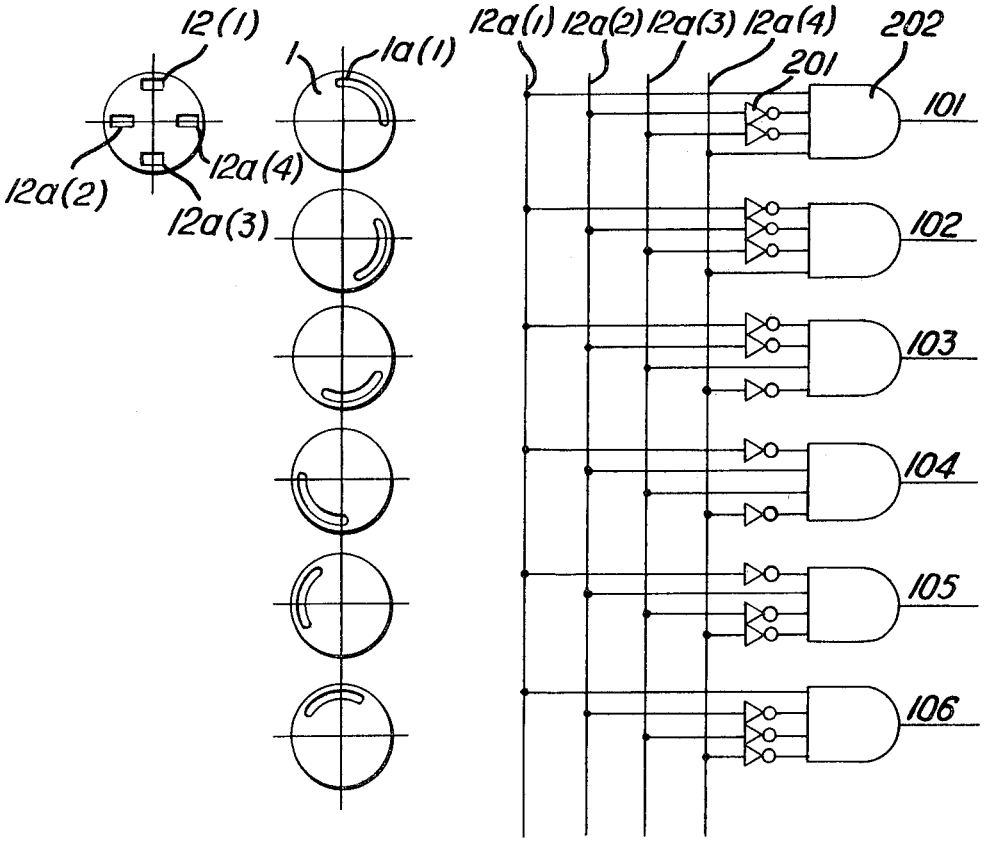

FIG. 17 shows a logic diagram combining the switch inputs of the fourth embodiment according to the present invention. Whenthe dial 1 rotates six times at 60° increments, six switching oprations are carried out. Since the switch terminal patterns 12*a*(1) and 12*a*(4) correspond to the position of the convex portion 1*a*(1) on the dial 1, the switching operations are carried out and an AND circuit 202 produces a signal 101. Since the other switch terminal patterns 12*a*(3) and 12*a*(2) do not correspond to the convex portion 1*a* on the dial 1, the switching operations are not carried out, and the outputs are inverted from an OFF state to an ON state by an inverter 201 before they are fed to the AND circuit 202. As a result the AND circuit 202 is turned on and produces the signal 101. After this, six switching operations are carried out by rotating the dial 1 at 60° increments six times.

As illustrated in detail, the present invention enables a watch to carry out more switching operations than the number of switch terminal patterns and to incorporate multifunctioned specifications easily by providing a plurality of switch terminal patterns on a circuit board and convex or concave portions on a dial.

I claim:

1. In an electronic watch operable in a plurality of modes: a watchcase body; a dial rotatably mounted on said case body; a plurality of camming portions provided on said dial and disposed in a circular pattern concentric with said dial; a circuit board within said case body; a plurality of switch terminal patterns deposited on an outer peripheral portion of said circuit board and being disposed in a circular pattern concentric with said dial; means including a plurality of reciprocable rods selectively engageable with the camming portions on the dial and positioned at respective ones of said switch terminal patterns to undergo reciprocal movement for selectively actuating said switch terminal patterns under the control of respective ones of the camming portions on the dial in accordance with the stepwise rotation of the dial; and circuitry connected to said switch terminal patterns for producing a different mode recalling signal in response to a different combination of said actuated switch terminal patterns.

2. A rotary switch as claimed in claim 1, wherein said means for selectively actuating said switch terminal patterns includes a mode change-over switch plate coacting with each reciprocable rod to actuate the switch terminal patterns.

3. A rotary switch as claimed in claim 1, comprising means including a gasket encircling each reciprocable rod to water-proof said case.

4. An electronic watch as claimed in claim 1, wherein the dial includes indicia identifying the names of each mode.

5. An electronic watch as claimed in claim 1, wherein said plurality of switch terminal patterns comprises four switch terminal patterns on said circuit board and said plurality of camming portions comprises six camming portions on said dial at positions corresponding to said switch terminal patterns to carry out twelve switching operations.

6. An electronic watch as claimed in claim 1, wherein the plurality of switch terminal patterns comprises four switch terminal patterns on said circuit board and said plurality of camming portions comprises three camming portions on said dial at positions corresponding to said switch terminal patterns to carry out eight switching operations by rotating the dial.

7. An electronic watch as claimed in claim 1, wherein the plurality of switch terminal patterns comprises three switch terminal patterns on said circuit board and said plurality of camming portions comprises three camming portions on said dial at positions corresponding to said switch terminal patterns to carry out six switching operations by rotating the dial.

8. An electronic watch as claimed in claim 1, wherein said plurality of switch terminal patterns comprises four switch terminal patterns on said circuit board at intervals of 90° respectively, and said plurality of camming portions include a camming portion of an arc shape having an angular extent within the range of 90° to 260° on said dial at a position corresponding to said switch terminal patterns to carry out six switching operations by rotating the dial.

9. In a multi-mode electronic timepiece, the combination comprising: an annular dial; a timepiece case including means mounting said dial for angular stepwise displacement in predetermined angular steps relative to the timepiece case; a circuit board within said timepiece case; a plurality of actuatable switch terminal patterns disposed on said circuit board in a pattern concentric with said annular dial and angularly spaced at intervals which are integer multiples of the predetermined angular steps through which said dial is angularly displaceable; a plurality of switches disposed in a pattern concentric with said annular dial and operative to actuate respective ones of the switch terminal patterns, each switch including a movable rod movable between a first position in which the rod effects actuation of its respective switch terminal pattern and a second position in which the rod does not effect actuation of its respective switch terminal pattern; a plurality of switch actuators disposed in a pattern on said annular dial for selectively effecting movement of the switch rods between their first and second positions in accordance with the annular stepwise displacement of said dial, said switch actuators being spaced at intervals which are integer multiples of the predetermined angular steps through which said dial is angularly displaceable and in a different pattern than the pattern in which said switches are spaced; and mode signal generating means connected to said plurality of switch terminal patterns for generating a different mode signal for each angular position of said dial according to which ones of said switch terminal patterns are actuated by said switches and switch actuators.

10. In a multi-mode electronic timepiece according to claim 9, wherein said plurality of switches is four switches, said plurality of switch actuators is six switch actuators, and said mode signal generating means in combination with said switches and switch actuators is effective to generate twelve different mode signals.

11. In a multi-mode electronic timepiece according to claim 9, wherein said plurality of switches is four switches, said plurality of switch actuators is three switch actuators, and said mode signal generating means in combination with said switches and switch actuators is effective to generate eight different mode signals.

12. In a multi-mode electronic timepiece according to claim 9, wherein said plurality of switches is three switches, said plurality of switch actuators is three switch actuators, and said mode signal generating means in combination with said switches and switch actuators is effective to generate six different mode signals.

13. In a multi-mode electronic timepiece according to claim 9, wherein said plurality of switches is four switches spaced at intervals of 90°, said plurality of switch actuators are defined by a continuous arc-shaped switch actuator extending through an arc of between 90° and 260°, and said mode signal generating means in combination with said switches and switch actuators is effective to generate six different mode signals.

14. In a multi-mode electronic timepiece according to claim 9, wherein said plurality of switch actuators are disposed on the underside of the annular dial in opposed facing relation with respect to one of the ends of the switch rods.

15. In a multi-mode electronic timepiece according to claim 14, wherein said plurality of actuators comprise camming portions disposed on the dial underside configured to cam the switch rods between their first and second positions during the angular stepwise displacement of the annular dial.

16. In a multi-mode electronic timepiece according to claim 14, wherein the camming portions comprise uneven surface portions of the dial underside.

17. In a multi-mode electronic timepiece according to claim 9, wherein the pattern of the switch terminal patterns, switches and switch actuators all comprise circular patterns concentric with the annular dial.

18. In a multi-mode electronic timepiece according to claim 9, including indicia disposed circumferentially around the annular dial indicating the different modes of the multi-mode electronic timepiece.

* * * * *